United States Patent [19]

Elwell

[11] 4,166,577

[45] Sep. 4, 1979

[54] LIQUID INJECTION DEVICE

[75] Inventor: Stephen J. Elwell, Romford, England

[73] Assignee: Plessey Handel und Investments AG, Zug, Switzerland

[21] Appl. No.: 788,937

[22] Filed: Apr. 19, 1977

[30] Foreign Application Priority Data

May 4, 1976 [GB] United Kingdom ..... 18073/76

[51] Int. Cl.[2] ..... B05B 3/14

[52] U.S. Cl. ..... 239/102

[58] Field of Search ..... 239/101, 102, 585; 251/139, 140, 141

[56] References Cited

U.S. PATENT DOCUMENTS

| | | | |
|---|---|---|---|
| 3,355,145 | 11/1967 | Castelet | 251/141 |
| 3,865,312 | 2/1975 | Lombard et al. | 239/585 |
| 3,949,938 | 4/1976 | Goodinge | 239/102 X |

FOREIGN PATENT DOCUMENTS

| | | | |
|---|---|---|---|
| 1011205 | 6/1952 | France | 251/141 |

*Primary Examiner*—John J. Love

*Attorney, Agent, or Firm*—Fleit & Jacobson

[57] ABSTRACT

A liquid injection device comprising a housing; a liquid bore in the housing; an orifice in the housing through which the liquid is injected; a liquid chamber arranged upstream of the orifice; a valve which is normally arranged to close the orifice; the valve being adapted to be moved electrically away from the orifice, and the valve being a close fit in the liquid chamber so that substantially no liquid can pass directly from the liquid bore to the orifice by passing between the valve and the walls of the liquid chamber; an annular liquid passage surrounding the liquid chamber; first passage means by which the liquid can pass to the annular liquid passage; and second passage means arranged downstream of the first passage means; the liquid injection device being such that when the valve is moved away from the orifice, the liquid in the annular liquid passage passes through the second passage means for injection through the orifice and also forces the valve towards the bore whereby the nearer the valve moves towards the bore then the greater is the force of the liquid in the bore tending to return the valve to the orifice.

9 Claims, 1 Drawing Figure

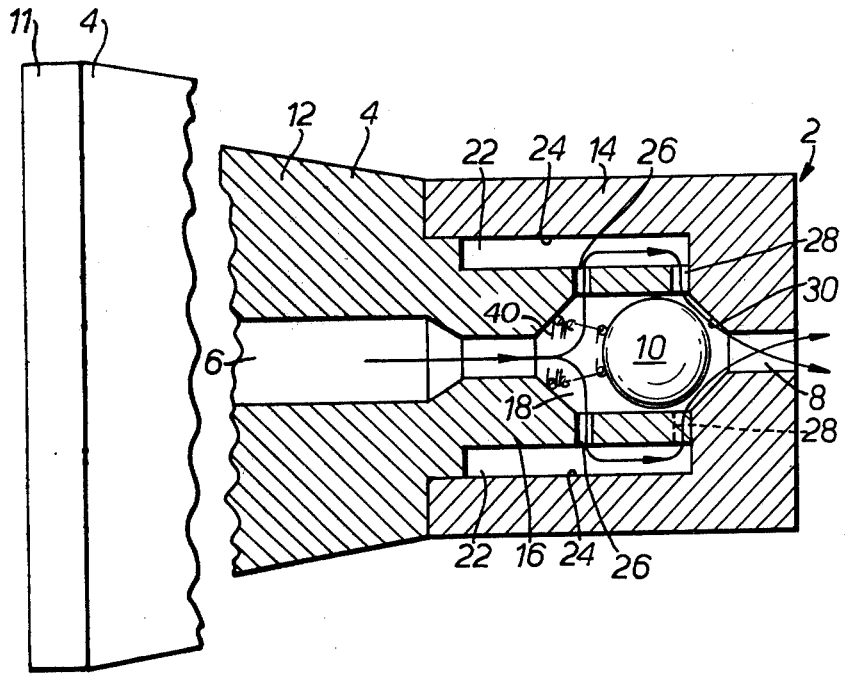
11
4
12
4
22
24
14
26
2
28
30
40
10
6
18
8
28
22
16
24
26

LIQUID INJECTION DEVICE

This invention relates to a liquid injection device.

Liquid injection devices are known in which a valve normally closes an injection orifice and is electrically moved off its seat when it is desired to inject a liquid through the injection orifice. When the liquid injection is to stop, the current is switched off and the valve is moved back to its seat by liquid pressure in the injection device.

In the known devices, the distance of the valve from its orifice often varies, even though the time periods that the current is on are the same. If the known liquid injection devices are fed with a series of equal current bursts, the distance moved by the valve from its seat during each current burst may vary. Furthermore, the known liquid injection devices may not be able to precisely control the return of the valve to its orifice, so that the time for the injection device to shut off at the end of each current burst (i.e. the time required for the valve to return to its orifice) may vary depending on the distance of the valve from the orifice. This means that if the known liquid injection devices are fed with a series of equal current bursts, the amount of liquid injected during each current burst may vary.

This varying of the amount of liquid injected under equal current bursts can be disadvantageous. Thus, for example, in the motor vehicle industry, it is desirable to feed precisely the same amount of fuel to an engine during each engine cycle. If the amount of injected fuel varies, then the resultant air/fuel mixture fed to the engine may sometimes be too rich in fuel and may sometimes be too poor in fuel.

It is an aim of the present invention to provide a liquid injection device enabling a precise control over the amount of liquid injected during equal current bursts applied to the device.

Accordingly, this invention provides a liquid injection device comprising a housing; a liquid bore in the housing; an orifice in the housing through which the liquid is injected; a liquid chamber arranged upstream of the orifice; a valve which is normally arranged to close the orifice, the valve being adapted to be moved electrically away from the orifice, and the valve being a close fit in the liquid chamber so that substantially no liquid can pass directly from the liquid bore to the orifice by passing between the valve and the walls of the liquid chamber; an annular liquid passage surrounding the liquid chamber; first passage means by which the liquid can pass to the annular liquid passage; and second passage means arranged downstream of the first passage means; the liquid injection device being such that when the valve is moved away from the orifice, the liquid in the annular liquid passage passes through the second passage means for injection through the orifice and also forces the valve towards the bore whereby the nearer the valve moves towards the bore then the greater is the force of the liquid in the bore tending to return the valve to the orifice.

Since the force of the liquid in the bore acting on the valve increases as the valve gets nearer the bore, the valve will be forced proportionally harder and therefore faster towards its orifice the more it moves away from its orifice. This varying return force on the valve is effective to ensure that the liquid shut-off time of the injection device is substantially constant. For example, if the current applied to the injection device is shut off when the valve is only a little distance from the orifice, then only a relatively gentle return force will be exerted by the liquid in the bore. If the current applied to the injection device is shut off when the valve is a large distance from the orifice, then a relatively strong force will be exerted by the liquid in the bore. The difference in the return forces will be effective to substantially standardize the time that the valve takes to return to its orifice, irrespective of its starting distance from the orifice.

Valve return time standardization can also be facilitated by the fact that as the valve moves nearer to the bore it will tend to shut off the liquid flow from the bore and the first passage means to the annular liquid passage. If the end of a current burst occurs when the valve is near the bore, there will be a reduced amount of fuel passing to the annular liquid passage for injection through the orifice via the second passage means. Thus there will be a reduced liquid pressure in the liquid chamber downstream of the valve and this will facilitate the speedy return of the valve by the liquid pressure in the bore.

Various types of liquid may be injected by the device of the present invention. Preferably, the liquid is a fuel for an engine, for example a four or two stroke engine. However, other liquids may be injected such for example as detergents and oils.

Especially in the case of fuel injection, it will be desirable that the fuel be injected in a finely divided spray. Accordingly, in one preferred embodiment of the invention, the valve is moved away from its position in which it closes the orifice in the housing by means of a piezoelectric device which is effective not only to move the valve away from the orifice but also to vibrate the liquid injection device. This vibration is effective to assist in atomizing the fuel as it passes through the orifice. If it is not desired to vibrate the liquid injection device, then the valve may be moved away from the orifice by means of a magnetostrictive device such for example as a solenoid situated around the outside of the liquid injection device and in the vicinity of the valve. In the case of the magnetostrictive device, it will be appreciated that the current bursts applied to the device will be effective to magnetise the solenoid which will then magnetise the valve away from its orifice.

Preferably, the second passage means form swirler slots which are effective to swirl the liquid as it passes from the annular liquid passage to the orifice. Usually, the swirler slots will be arranged to deliver liquid from the annular liquid passage tangentially into the liquid chamber at a point downstream of the valve when the valve has been moved away from the orifice. The swirling of the liquid facilitates its atomization and is thus especially advantageous when the liquid is a fuel.

Preferably, the first passage means connects the liquid chamber and the annular liquid passage. However, if desired, the first passage means could connect the bore and the annular liquid passage.

Preferably, the valve is a ball valve but other types of valve may be employed. Thus, for example, the valve could be elongate in shape and could have a conical end which would be effective to progressively fit in the plug bore.

If desired, the valve may be spring biassed towards the position in which it closes the orifice in the housing, the spring biassing means being effective to help in achieving a speedy liquid shut-off.

An embodiment of the invention will now be described solely by way of example and with reference to the accompanying drawing which shows a liquid injection device in accordance with the invention, the device being useful for injecting fuel into an air duct leading to an engine.

Referring to the drawing, there is shown a fuel injection device 2 comprising a housing 4 having a fuel bore 6 and a fuel orifice 8. The orifice 8 is arranged to be normally closed by a ball valve 10. The valve 10 is moved away from the orifice 8 by means of an electric current applied to a piezoelectric device 11 attached to the housing 4. The piezoelectric device 11 vibrates the housing 4 and this vibration moves the valve 10 to the left as shown in the drawing.

The housing 4 comprises a main body part 12 and an end cap 14. The body part 12 is provided with an extension portion 16 which extends into the cap 14 as shown. The bore 6 extends into the portion 16 and terminates in a fuel chamber 18.

As will be seen from the drawing, an annular fuel passage 22 is formed between the outer surface of the extension portion 16 and the walls 24 of the cap 14. The portion 16 is provided with first passage means in the form of four fuel slots 26 and second passage means in the form of four swirler slots 28.

With the ball 10 in a position closing the orifice 8, fuel will be in the bore 6, the chamber 18, the slots 26 and the annular passage 22. When a burst of current is applied to the piezoelectric device 11, the valve 10 is moved off its seat and fuel from passage 22 passes through the slots 28 and swirls in the chamber 18 downstream of the valve 10. Some of this fuel is then injected through orifice 8 and some of this fuel acts on the valve 10 to force it to the left as shown in the drawing. As the ball valve 10 is forced to the left as shown in the drawing, it will ultimately block the slots 26 and also the bore 6.

When the electric current applied to the device 11 is interrupted, the device 2 will stop vibrating and the valve 10 will be free to return to its seat 30. The fuel in the bore 6 will force the ball valve 10 to the right as shown in the drawing and back to its valve seat 30 where it will close the orifice 8. The nearer the valve 10 is to the bore 6 when the current is interrupted, then the greater will be the force of the fuel acting on the valve 10. When the valve 10 is back on its seat 30, the device 11 may be given another burst of electrical energy and the valve 10 will again be kicked off its seat 30 and the cycle will recommence. As the valve 10 moves towards the bore 6, it tends to shut off the fuel flow through the slots 26 to the passage 22. This means that less fuel is in the passage 22 for feeding through the slots 28 to the side of the chamber 18 downstream of the valve 10. There will thus be a reduced fuel pressure in this downstream part of the chamber 18 which will facilitate the speedy return of the valve 10 under the action of the fuel in the bore 6. The return of valve 10 can be assisted by a spring 40.

It is to be appreciated that the embodiment of the invention described above has been given by way of example only and that modifications may be effected. Thus, for example, the ball valve 10 may be replaced by an elongate valve having a conical end effective to progressively enter the bore 6. Also, if desired, the piezoelectric device 11 may be replaced by a solenoid arrangement placed around the outside of the housing 4. When an electrical pulse is applied to the solenoid arrangement, the valve 10 will be magnetised off its seat.

What I claim is:

1. A liquid injection device comprising a housing; a liquid bore in the housing; an orifice in the housing for injecting atomized liquid; a liquid chamber connected to and arranged upstream of the orifice; a valve which is normally arranged to close the orifice, the valve being adapted to be moved electrically away from the orifice, and the valve being a close fit in the liquid chamber so that substantially no liquid can pass directly from the liquid bore to the orifice by passing between the valve and the walls of the liquid chamber; an annular liquid passage surrounding the liquid chamber; first passage means for passing liquid from the liquid chamber to the annular liquid passage; and second passage means arranged downstream of the first passage means for passing liquid to the orifice; the liquid injection device being such that when the valve is moved away from the orifice, the liquid in the annular liquid passage passes through the second passage means and is atomized for injection through the orifice and also forces the valve towards the bore whereby as the valve moves towards the bore the size of said first passage means is reduced thereby increasing the force tending to return the valve to the orifice.

2. A liquid injection device according to claim 1 in which the second passage means form swirler slots which are effective to swirl the liquid as it passes from the annular liquid passage to the orifice.

3. A liquid injection device according to claim 2 in which the swirler slots are arranged to deliver liquid from the annular liquid passage tangentially into the liquid chamber at a point downstream of the valve when the valve has been moved away from the orifice.

4. A liquid injection device according to claim 1 in which the valve is a ball valve.

5. A liquid injection device according to claim 4 in which the valve is spring biassed towards the position in which it closes the orifice in the housing.

6. A liquid injection device according to claim 1 in which the first passage means connects the liquid chamber and the annular liquid passage and in which the valve is movable into a position blocking liquid flow between said liquid chamber and said first passage means.

7. A liquid injection device according to claim 1 in which the orifice has an axial length sufficiently short that the atomized liquid is not recondensed prior to injection.

8. A liquid injection device according to claim 1 in which the portion of the housing containing the orifice is adapted to be vibrated and in which the device further comprises electrically operated means for vibrating the housing so that the valve is moved away from the orifice by vibration.

9. A liquid injection device according to claim 8 in which the electrically operated means is a piezoelectric device.

* * * * *